US007967914B2

(12) United States Patent
Giddings et al.

(10) Patent No.: US 7,967,914 B2
(45) **Date of Patent: *Jun. 28, 2011**

(54) METHOD AND APPARATUS FOR CLEANING FABRICS, FLOOR COVERINGS, AND BARE FLOOR SURFACES UTILIZING A SOIL TRANSFER MEDIUM

(75) Inventors: Daniel G. Giddings, Holland, MI (US); Frederick A. Hekman, Holland, MI (US); Richard W. Wellens, Plymouth, MN (US); Larry D. Wydra, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/540,200

(22) Filed: Aug. 12, 2009

(65) Prior Publication Data

US 2009/0293912 A1 Dec. 3, 2009

Related U.S. Application Data

(63) Continuation of application No. 10/705,570, filed on Nov. 10, 2003, now abandoned, which is a continuation-in-part of application No. 10/081,374, filed on Feb. 22, 2002, now Pat. No. 6,662,402.

(60) Provisional application No. 60/299,561, filed on Jun. 20, 2001.

(51) Int. Cl.
*B08B 5/04* (2006.01)

(52) U.S. Cl. ..... 134/6; 134/21

(58) Field of Classification Search ..... 134/6, 21, 134/32, 33, 34; 15/320, 321, 340
See application file for complete search history.

(56) References Cited

U.S. PATENT DOCUMENTS

| | | | |
|---|---|---|---|
| 990,775 | A | 4/1911 | Reid |
| 1,268,963 | A | 6/1918 | Gray |
| 2,518,183 | A | 8/1950 | Renne |
| 3,631,558 | A | 1/1972 | Kovacevic |
| 3,696,458 | A | 10/1972 | Leifheit et al. |
| 3,750,217 | A | 8/1973 | Liebscher |
| 3,761,985 | A | 10/1973 | Leifheit |
| 3,843,989 | A | 10/1974 | DeMaagd |

(Continued)

FOREIGN PATENT DOCUMENTS

| | | |
|---|---|---|
| DE | 6934247 | 1/1970 |

(Continued)

OTHER PUBLICATIONS

Search Report for PCT/US2004/037644 mailed May 10, 2005.

*Primary Examiner* — Michael Barr
*Assistant Examiner* — Saeed T Chaudhry
(74) *Attorney, Agent, or Firm* — Briggs and Morgan, P.A.

(57) ABSTRACT

An apparatus and method for cleaning fabrics, floor coverings, and bare floor surfaces utilizing a soil transfer cleaning medium is disclosed. A method of mechanically removing soil from a surface intended to be cleaned includes the steps of successively and repeatedly: wetting a portion of a cleaning medium with a cleaning liquid; extracting any soil and at least some of the cleaning liquid from the previously wetted portion of the cleaning medium; and wiping the surface intended to be cleaned with the portion of the cleaning medium so as to transfer soil from the surface intended to be cleaned to the cleaning medium. Portable and vehicle-based devices may be utilized to practice the method of cleaning.

18 Claims, 7 Drawing Sheets

U.S. PATENT DOCUMENTS

| | | | | |
|---|---|---|---|---|
| 3,871,051 | A | 3/1975 | Collier | |
| 3,875,605 | A | 4/1975 | Fegan | |
| 3,936,199 | A | 2/1976 | Zimmerman | |
| 3,983,592 | A | 10/1976 | Fegan | |
| 4,245,371 | A | 1/1981 | Satterfield | |
| 4,360,946 | A | 11/1982 | Marshall, Jr. et al. | |
| 4,369,544 | A | 1/1983 | Parisi | |
| 4,433,451 | A | 2/1984 | Parisi | |
| 4,570,278 | A | 2/1986 | Bloome et al. | |
| 4,573,235 | A | 3/1986 | Baird, Sr. et al. | |
| 4,654,916 | A | 4/1987 | Postonen et al. | |
| 4,845,794 | A | 7/1989 | Korski et al. | |
| 4,884,310 | A | 12/1989 | Knestele | |
| 4,914,773 | A | 4/1990 | Ham | |
| 5,086,539 | A | 2/1992 | Rench | |
| 5,203,047 | A | 4/1993 | Lynn | |
| 5,241,724 | A | 9/1993 | Lim | |
| 5,287,581 | A | 2/1994 | Lo | |
| 5,309,597 | A | 5/1994 | Wymore | |
| 5,371,912 | A | 12/1994 | Hall | |
| 5,404,609 | A | 4/1995 | Rench et al. | |
| 5,465,456 | A | 11/1995 | Fellhauer et al. | |
| 5,483,718 | A | 1/1996 | Blehert et al. | |
| 5,515,568 | A | 5/1996 | Larson et al. | |
| 5,657,504 | A | 8/1997 | Khoury | |
| 5,697,119 | A * | 12/1997 | Mussalo | 15/320 |
| 5,699,576 | A | 12/1997 | Sohaiby | |
| 5,715,565 | A | 2/1998 | Kern | |
| 5,797,163 | A | 8/1998 | Whitaker et al. | |
| 5,813,086 | A | 9/1998 | Ueno et al. | |
| 5,901,410 | A | 5/1999 | Windmeisser | |
| 5,933,900 | A | 8/1999 | Wang | |
| 6,030,465 | A | 2/2000 | Marcussen et al. | |
| 6,055,699 | A | 5/2000 | Cho | |
| 6,088,873 | A | 7/2000 | Pacchini et al. | |
| 6,145,145 | A * | 11/2000 | Besel | 15/22.3 |
| 6,367,120 | B2 | 4/2002 | Beauchamp | |
| 6,438,793 | B1 | 8/2002 | Miner et al. | |
| 6,735,812 | B2 * | 5/2004 | Hekman et al. | 15/320 |
| 2003/0159232 | A1 * | 8/2003 | Hekman et al. | 15/320 |
| 2004/0049878 | A1 * | 3/2004 | Thomas et al. | 15/320 |

FOREIGN PATENT DOCUMENTS

| | | |
|---|---|---|
| DE | 3616398 | 12/1986 |
| DE | 4117957 | 12/1992 |
| DE | 100200197 | 11/2001 |
| EP | 0286328 | 10/1988 |
| JP | 4920361 | 11/1974 |
| JP | 5094761 | 7/1975 |
| JP | 57189546 | 12/1982 |
| JP | 05123278 | 5/1993 |
| WO | WO 9749324 | 12/1997 |

* cited by examiner

METHOD AND APPARATUS FOR CLEANING FABRICS, FLOOR COVERINGS, AND BARE FLOOR SURFACES UTILIZING A SOIL TRANSFER MEDIUM

RELATED APPLICATIONS

This is a continuation of U.S. Ser. No. 10/705,570, filed Nov. 10, 2003, which was a continuation-in-part application of U.S. Ser. No. 10/081,374, now U.S. Pat. No. 6,662,402, which claimed priority to U.S. Ser. No. 60/299,561, filed Jun. 20, 2001, and each application being incorporated herein by reference for all purposes.

FIELD OF THE INVENTION

The present invention relates generally to surface maintenance or conditioning machines, and more particularly to those machines employing one or more surface maintenance or conditioning appliances or tools to perform a surface cleaning task.

BACKGROUND OF THE INVENTION

In general, proper carpet maintenance involves regular vacuuming and periodic cleaning to remove soil by methods such as hot water extraction, shampooing, bonnet cleaning, foam cleaning, etc. Some of the soil is loosely found between carpet fibers while other soil is held upon the carpet fibers by some means such as electrostatic forces, van der Waals forces, or oil bonding. Still other soil is mechanically trapped by carpet fibers. Regular vacuuming is essential as it removes some of the loose soil that damages the fibers. Vacuuming maintains the surface appearance of a carpet and keeps the level of soil in the pile at an acceptable level. Vacuuming removes only particulate soil and some unbound or loosely bound surface dirt; therefore, other methods of cleaning are periodically required to improve the appearance of the carpet. Wet cleaning methods are better for removing oils, greases, bound dirt, and other forms of matter that cause soiling on carpet. These methods are often used by professional cleaners and trained personnel.

One type of surface maintenance machine for carpet cleaning is referred to as a bonnet cleaner. Bonnet cleaners employ an absorbent bonnet or pad (hereinafter referred to as the "pad") attached to a rotary driver for rotating the pad about an axis generally perpendicular to the carpet surface. Cleaning liquid is sprayed directly onto the carpet followed by the rotating pad used to agitate the carpet and transfer soil from the carpet onto the bonnet, i.e., the pad. Since the pad is commonly two-sided, the pad may be reversed once one side of the pad gets soiled to a selected level. The pad may be periodically replaced and later cleaned depending upon the application and wear characteristics of the pad.

The soil transfer process of the bonnet cleaners may be characterized as a "circular engagement process" since the pad rotates relative to the carpet surface. The method employed by bonnet cleaners does have the advantage of being fast drying if a relatively small amount of cleaning liquid is employed. However, limitations of bonnet cleaners include transferring soil from soiled areas to a relatively cleaner area, leaving much of the cleaning fluid in the carpet, and having the potential to damage the carpet. With respect to the latter, some carpets, particular twisted ply variations, may be damaged by aggressive engagement with the rotating pad. Additionally, the bonnet cleaning process is a relatively labor intensive process since the pad requires frequent soil monitoring and frequent removal of soiled pads.

Yet another limitation of bonnet cleaners is the relatively uncontrolled use of cleaning liquid in the carpet cleaning process as some areas of the carpet may receive more cleaning liquid spray than other areas. Reliance on operator spraying of cleaning liquid to the carpet surface may result in overwetting of some areas and underwetting of other areas.

Another type of surface maintenance machine intended for carpet cleaning is referred to as an "extractor machine." Extractor machines are commonly used for deep carpet cleaning. In general, an extractor is a transportable self-contained device which (i) sprays cleaning liquid directly onto the carpet to create a wetted carpet portion, (ii) agitates the wetted portion with a brush, and (iii) removes some of the cleaning liquid and soil in the carpet through a vacuum system. Generally, in the extraction process a relatively large quantity of cleaning liquid is applied on the carpet. While the vacuum system recovers a portion of the applied cleaning liquid, a significant portion is retained by the carpet. As a consequence, carpet drying times are substantially longer than in the bonnet cleaning process. Excessive carpet wetting may promote the growth of fungus and/or bacteria within the carpet. Additionally, carpet overwetting may also cause surface stains to appear or reappear as underlying soil or stains migrate from the bottom of the carpet to its surface. Additionally, extractors are generally limited to a single operational direction as the steps of wetting, agitation, and vacuuming are sequentially performed. As a result, extractor machines may be difficult to maneuver in some environments, i.e., complex floor layouts.

SUMMARY AND OBJECTS OF THE INVENTION

An object of the present invention is the provision of a carpet cleaning machine promoting efficient use of cleaning liquid in carpet cleaning.

Another object of the present invention is to enhance cleaning area per unit of cleaning solution.

Another object of the present invention is to provide a cleaning method that permits a carpet to dry more rapidly.

Yet another object of the present invention is to provide a carpet cleaning process that has the ability to lift carpet pile which exposes more of the carpet fibers to the surrounding drying air so as to permit the carpet to dry more rapidly than if the pile was not lifted.

Yet another object of the present invention is the provision of a cleaning process and apparatus for cleaning a variety of surfaces, including but not limited to floor surfaces, stairways, walls, and upholstered furniture or other fabric surfaces.

The present invention is directed both to a method of cleaning surfaces and an apparatus for performing the method. In a broad sense, the cleaning process is similar to a damp cloth wiping operation wherein soil from a surface is transferred to the damp cloth.

In accordance with the present invention, a revolving cleaning medium, which after being wiped against a surface intended to be cleaned is wetted, followed immediately by the step of extracting so as to remove cleaning solution and any soil from the cleaning medium, and again wiped against the surface—the process revolving or repeating. In a preferred operation, one portion of the cleaning medium is wetted with cleaning liquid, while another portion is being extracted to remove soil and cleaning liquid therefrom, and while yet another portion is being wiped against the surface to transfer soil from the surface to the cleaning medium. The process continues in a revolving or cyclical manner so that each portion of the cleaning medium is sequentially wetted, extracted, and wiped against the surface.

The method of cleaning surfaces in accordance with the present invention includes the steps of (i) wetting a revolving cleaning medium with a cleaning solution, (ii) followed by removing at least some of the cleaning liquid from the revolving cleaning medium directly after wetting by way of a moisture extraction device, and (iii) wiping the surface with the revolving cleaning medium so as to transfer soil from the surface to the revolving cleaning medium and subsequently removing transferred soil from the revolving cleaning medium.

In accordance with present invention, a transportable device is utilized to perform the cleaning process on a carpeted surface. The device may be a relatively portable machine having a cleaning liquid tank, a soiled solution recovery tank, a vacuum system, and cleaning head. The cleaning head may include a revolving cleaning medium and associated drive mechanism. A vacuum extractor may be used to engage the cleaning medium to remove soil and at least some of the cleaning liquid from the cleaning medium.

In accordance with one embodiment of the invention the revolving cleaning medium is configured as a pair of counter rotating cylindrical cleaning media having portions of each successively wetted, extracted, and wiped against a surface intended to be cleaned, with the process repeating or revolving.

DETAILED DESCRIPTION OF THE INVENTION

The present invention is directed both to a method of cleaning surfaces and an apparatus for performing the method. In a broad sense as will subsequently be described, the cleaning process in accordance with the present invention is similar to a damp cloth wiping operation wherein soil from a surface is transferred to the damp cloth.

More particularly, the cleaning process in accordance with the present invention utilizes a revolving cleaning medium which after being wiped against a surface intended to be cleaned is wetted, followed immediately by the step of extracting so as to remove cleaning liquid, in part, and any soil from the cleaning medium, and again wiped against the surface—the process revolving or repeating.

In a preferred operation, one portion of the cleaning medium is wetted with cleaning liquid, while another portion is being extracted to remove soil and cleaning liquid therefrom, and while yet another portion is being wiped against the surface to transfer soil from the surface to the cleaning medium. The process continues in a revolving or cyclical manner so that each portion of the cleaning medium is sequentially wetted, extracted, and wiped against the surface.

Figure 1:
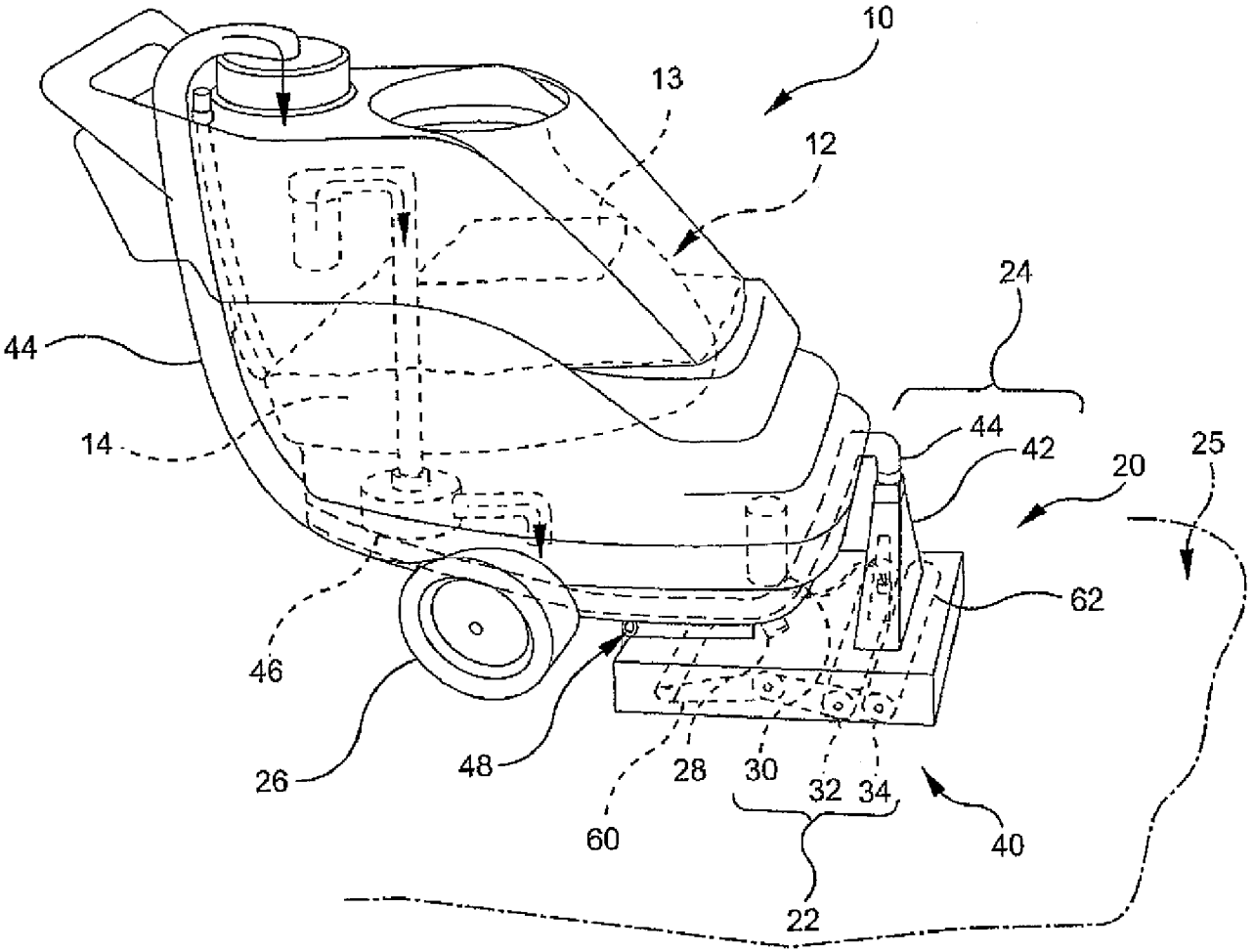
FIG. 1 is a perspective illustration of one embodiment of a cleaning machine according to the present invention.

FIG. 1 illustrates an embodiment of a transportable floor surface cleaning machine 10 according to the present invention. More particularly, machine 10, for illustrative purposes, is illustrated as an AC powered (with power cord not shown) self-contained portable carpet extractor similar to those known in the art, including a cleaning solution tank 12 for containing a cleaning liquid 13, such as a mixture of water and a cleaning chemical, a recovery tank 14, a cleaning head 20, a cleaning liquid dispenser 22, and a soiled solution extraction system 24 as further described herein. In operation, machine 10 is supported upon the ground surface 25 by rear wheels 26 and caster wheel 28. Representative examples of self-contained portable carpet extractors having cleaning solution tank 12, recovery tank 14, cleaning liquid dispenser 22, and soiled solution vacuum extraction system 24 include models 1230 and 1260 extractors manufactured by Tennant Company, Minneapolis, Minn. In an illustrated embodiment, cleaning head 20 in accordance with the present invention may be used in conjunction with one of such known walk-behind extractor machines and the like.

Figure 2:
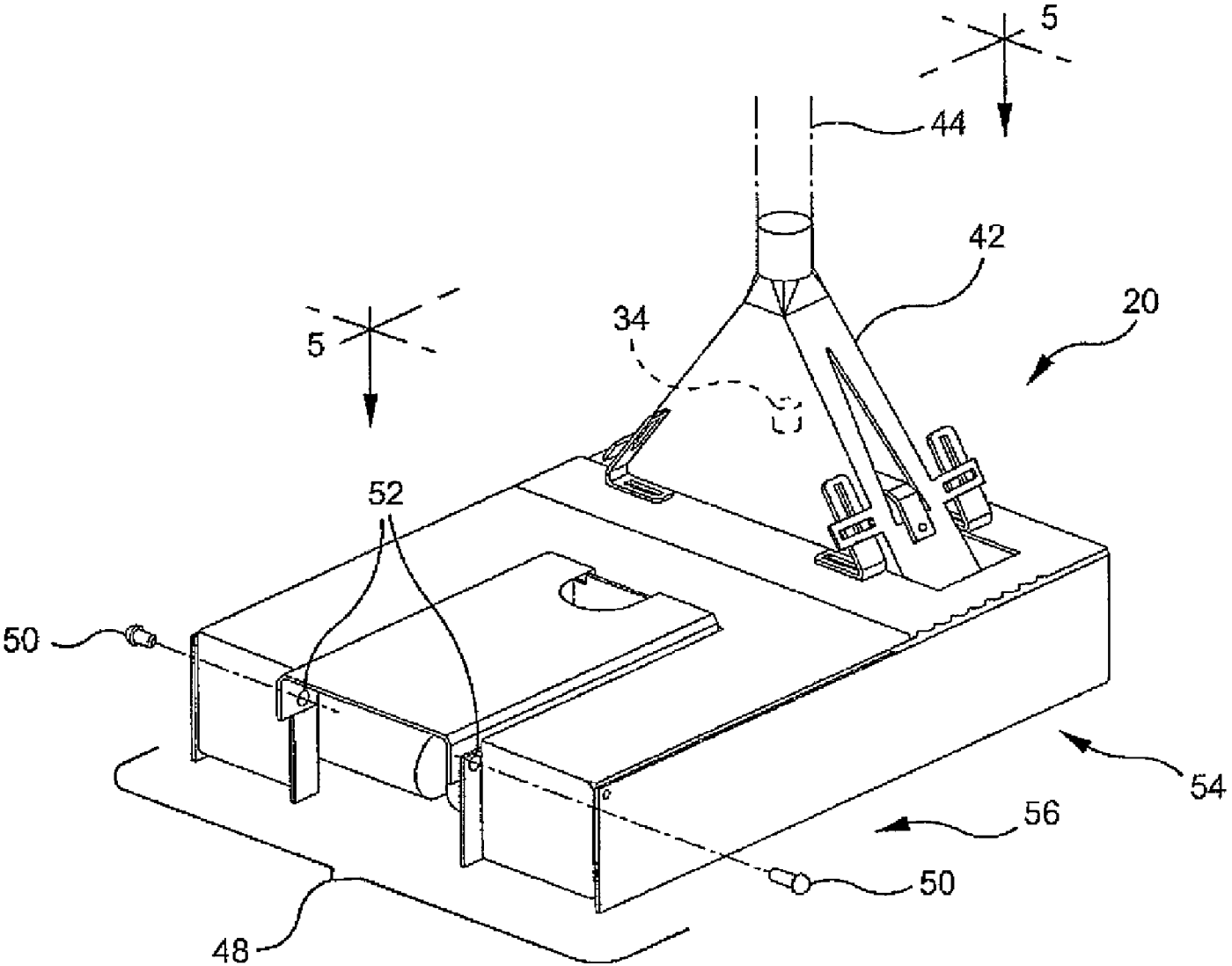
FIG. 2 is a perspective view of a cleaning head of the cleaning machine of FIG. 1.
Figure 3:
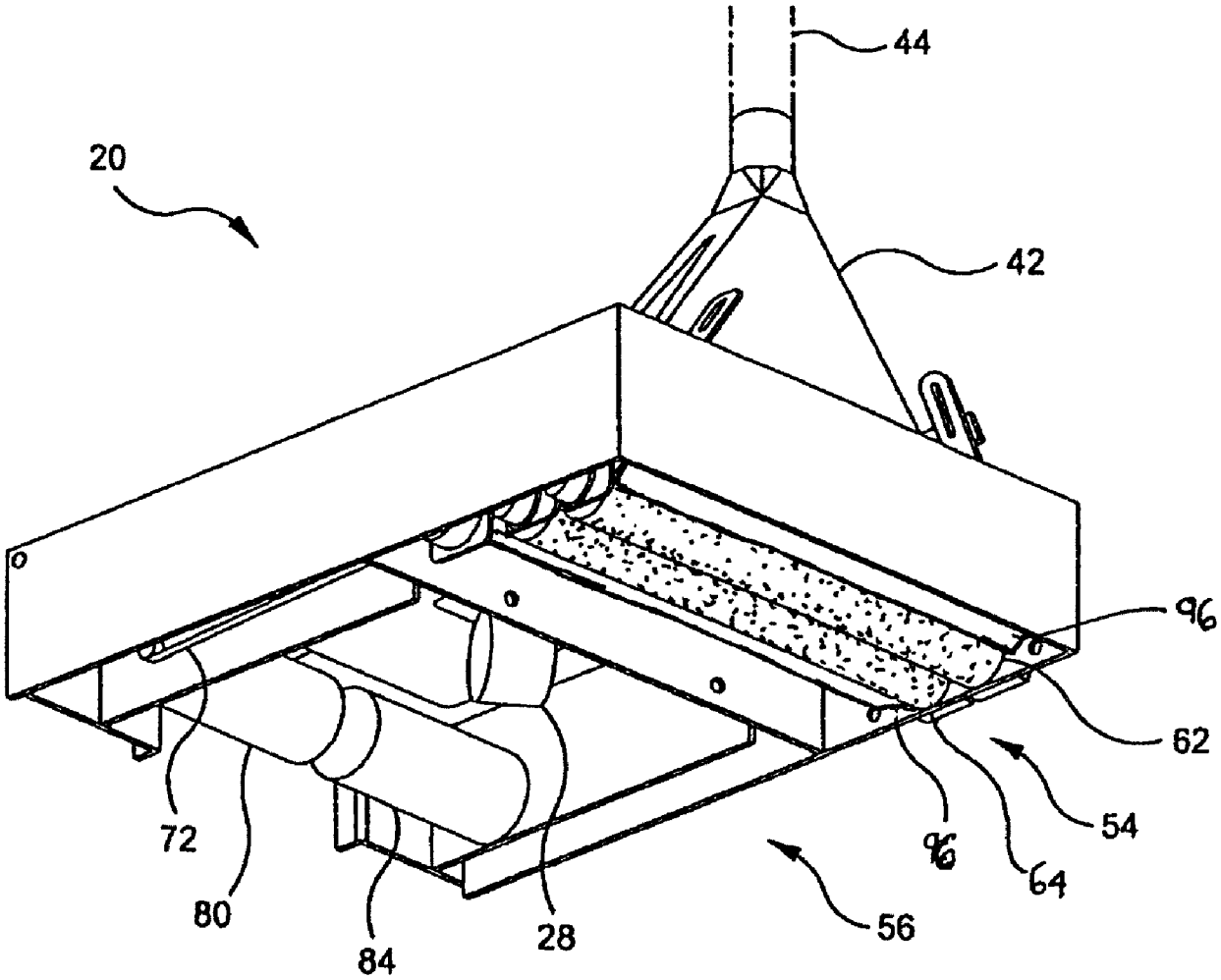
FIG. 3 is another perspective view of the cleaning head of FIG. 1.
Figure 4:
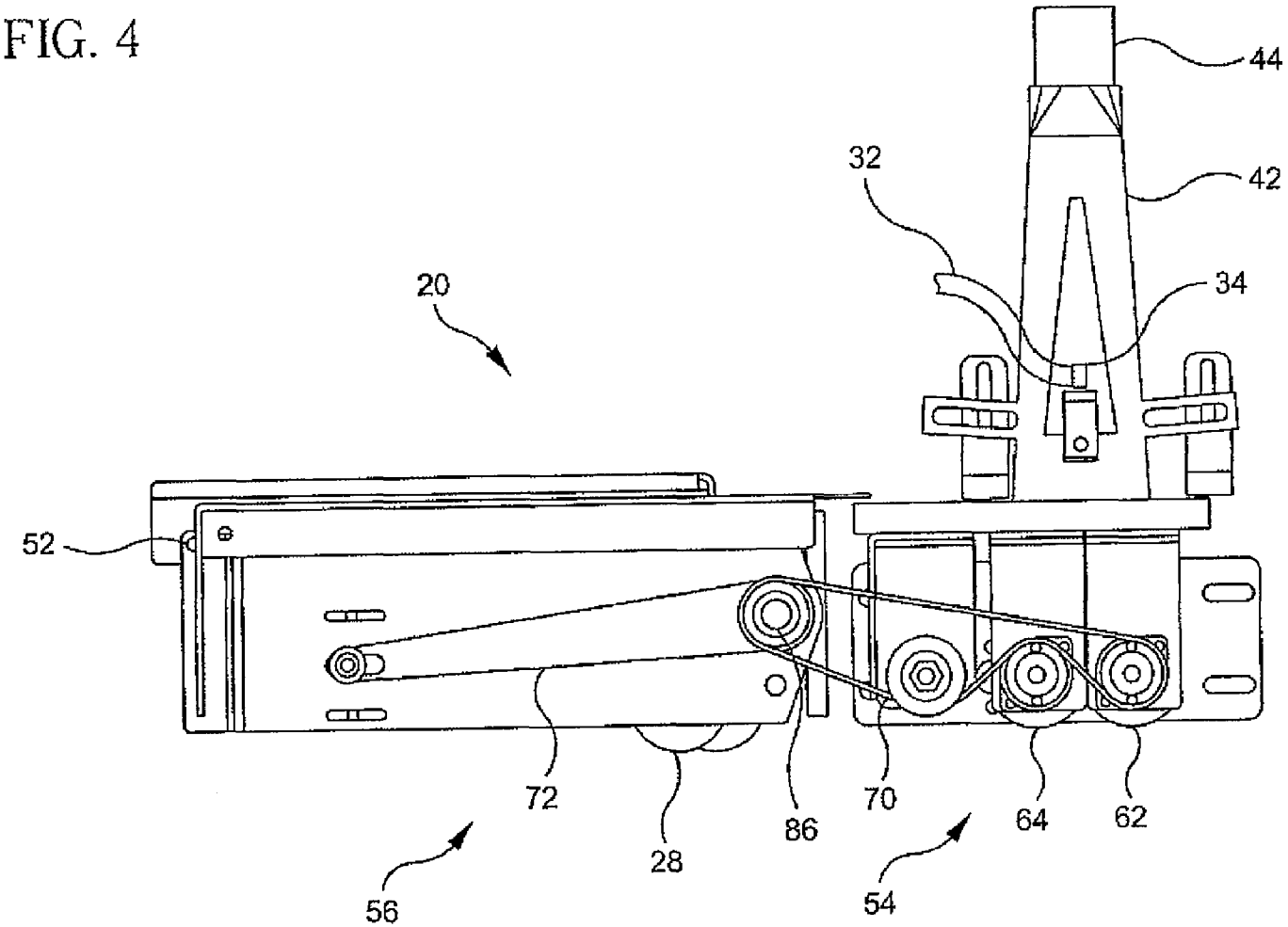
FIG. 4 is a side elevation view of the cleaning head of FIG. 1.

Cleaning head 20, in accordance with the present invention, includes a cleaning medium 40 and associated drive assembly 60 as is more particularly shown in detail in FIGS. 2 and 3. Drive assembly 60 selectively revolves cleaning medium 40 relative to cleaning head 20 and surface 25. In operation, cleaning medium 40 is intended to be first wetted with cleaning liquid 13 by cleaning liquid dispenser 22 and immediately followed by a moisture extraction process before being wiped against surface 25 so as to transfer soil from surface 25 to cleaning medium 40. In the extraction process, soil, as well cleaning solution resulting from the step of wetting the cleaning medium just performed, is removed from cleaning medium 40 by soiled solution extraction system 24. As further explained herein, cleaning medium 40 revolves during operation so that different portions of the cleaning medium 40 are simultaneously being wetted with cleaning liquid 13, extracted by extraction system 24, or wiped against the surface 25.

Referring to FIGS. 1 through 3, cleaning head 20 is attached at a forward portion of the machine 10 via a coupling structure 48. Coupling structure 48 includes a pair of fasteners 50 engaging apertures 52 in cleaning head 20 and permitting cleaning head 20 to pivot or rotate about an axis (not shown) passing through apertures 52. Cleaning head 20 may include one or more assemblies which are movably connected together so that the assemblies may move relative to each other so as to facilitate operational contact of the cleaning head 20 across undulating floor surfaces. In the illustrated embodiment, cleaning head includes forward and rear assemblies 54, 56, respectively. Forward assembly 54 includes cleaning medium 40 in the form of a pair of counter rotating cylindrical cleaning pads and/or brushes 62 and 64, and vacuum extractor 42. Rear assembly 56 includes cleaning medium drive assembly 60, coupling structure 48, and caster wheel 28. Caster wheel 28 is coupled to cleaning head 20 to support at least a portion of machine 10 on surface 25.

As described above, cleaning medium 40 functions to transfer soil from surface 25 to the cleaning medium 40. For a carpet surface, cleaning medium 40 functions to wipe the carpet and transfer soil from carpet fibers to the cleaning medium 40. A variety of different materials may be utilized as a cleaning medium, including but not limited to fabrics and absorbent foams, i.e., being "foam rubber" like. Cleaning medium 40 in one embodiment of the invention as illustrated in the Figures includes a pair of cylindrical devices, i.e., cylindrical cleaning pads and/or brushes 62 and 64, hereafter referred to as simply brushes. However, it should be noted herein that cylindrical brushes 62 and 64, i.e. the cleaning medium 40, may be a constructed from any combination of pad-like or bristle-like or foam-like materials, and the like, which serve to transfer soil from the surface intended to be cleaned unto the cleaning medium.

An exemplary construction of brushes 62 and 64 includes a substrate, such as a woven synthetic fabric, having pile fibers tufted thereinto. In one embodiment of the invention, the substrate has an appearance and feel that is similar to the surface fabric used on a common paint roller. In some instances, it may be desirable to intersperse stiffer fibers, i.e., brush like bristles, into the substrate to enhance the agitation action of cleaning medium 40. A 0.75 inch pile 100% nylon roller fabric may be utilized to cover an extruded PVC tubing to form brush 62, 64. Other materials and tube forms may be utilized to form brush 62, 64.

Figure 5:
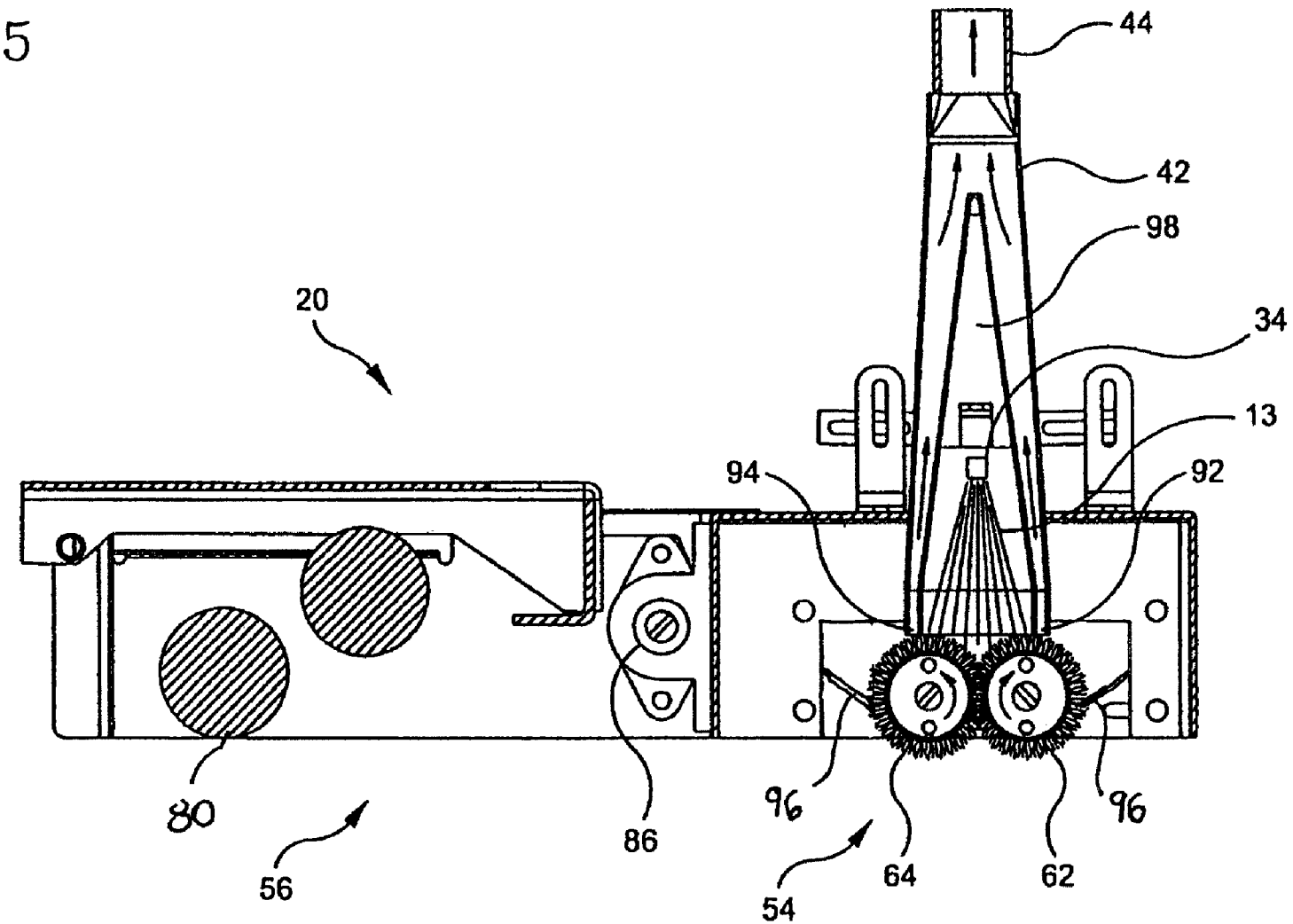
FIG. 5 is a cross sectional view of the cleaning head of FIG. 2, taken along lines 5-5.
Figure 6:
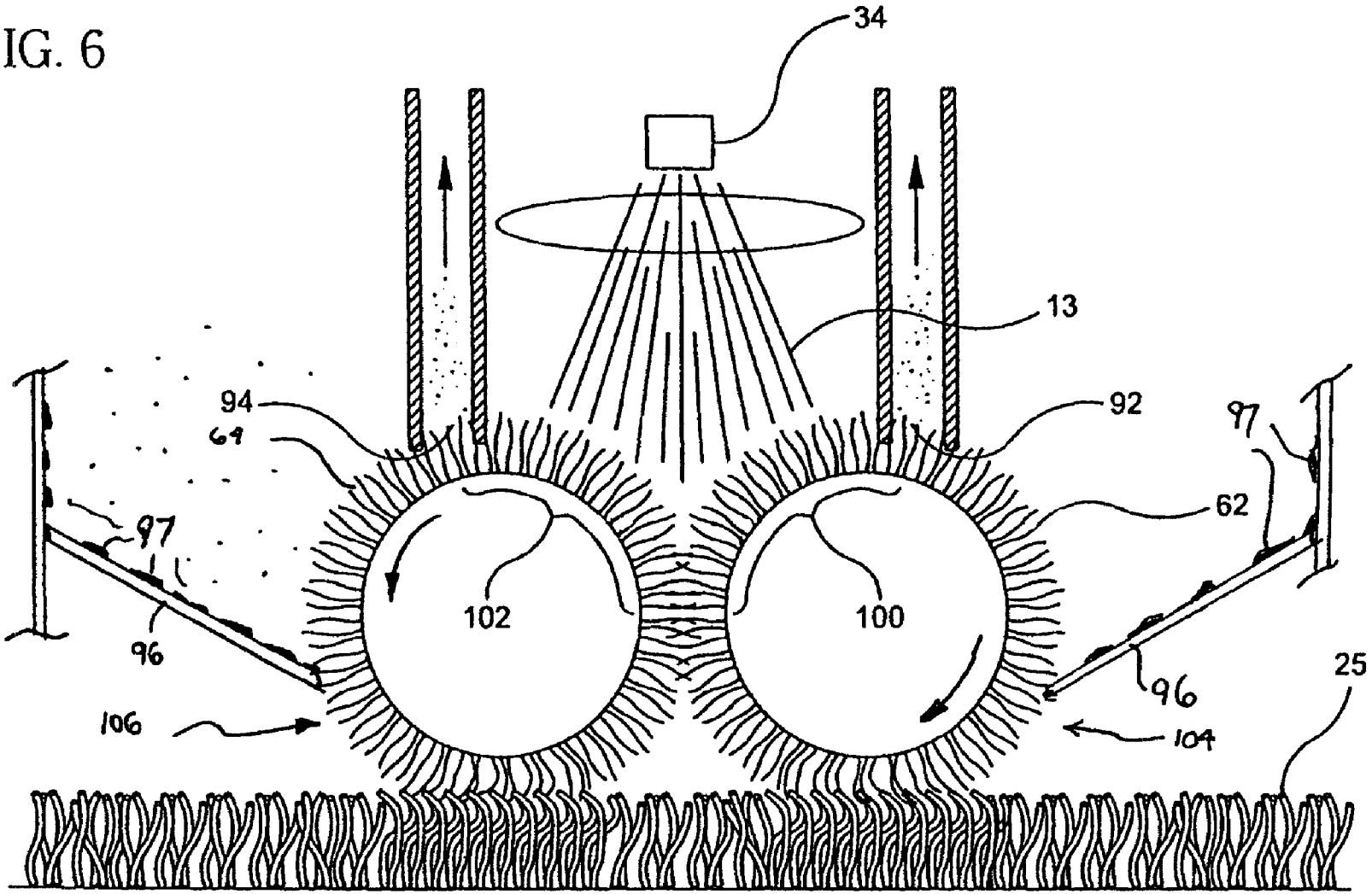
FIG. 6 is a detailed side elevational view of a portion of the cleaning head of FIG. 5.

With particular reference to FIGS. 4 through 7, brushes 62, 64 of cleaning medium 40 are rotatably driven by cleaning medium drive assembly 60. Drive assembly 60 includes drive belts 70, 72, 74, 76 and electric motors 80, 82, 84. Drive belt 70 is coupled to a common rotating jackshaft 86 which is driven by three small electric motors 80, 82, 84. Each motor 80, 82, 84 has an associated drive belt 72, 74, 76 to the jackshaft 86. In alternative embodiments, a single electric motor may be utilized to rotatably drive cylindrical brushes 62 and 64. As depicted in FIGS. 5 and 6, cleaning medium brushes 62, 64 are rotated in opposite directions during operation. To facilitate cleaning head 20 contact with floor surface 25 during operation, front and rear assemblies 54, 56 are pivotally coupled about jackshaft 86.

In an exemplary embodiment of the invention, cleaning dispenser 22 includes a pump 30, shown fixed to the main assembly of machine 10—see FIG. 1, for pumping cleaning liquid 13 through conduit 32 and nozzle 34 thereby delivering cleaning liquid 13 to brushes 62, 64. Appropriate fluid controls, such as switches, valves, etc. (not shown) are provided to control the application of cleaning fluid 13. As depicted in FIGS. 5 and 6, nozzle 34 spray is substantially directed to the cleaning medium brushes 62, 64, and not surface 25. Alternative dispensing means may include drip bars or tubes (not shown) for transferring cleaning liquid 13 to cleaning medium 40.

As indicated earlier, extraction system 24 is intended to remove cleaning liquid 13 and any soil from the cleaning medium 40, for example brushes 62 and 64. In the embodiment of the invention illustrated in the drawings, extraction system 24 includes a vacuum extractor 42 which engages brushes 62, 64, a vacuum conduit 44, and a vacuum fan 46 to remove soiled solution from brushes 62, 64 and to transfer soiled solution to recovery tank 14. As particularly illustrated in FIGS. 4 and 5, extractor 42 includes a bifurcated end having a pair of elongate vacuum apertures 92, 94 in operational contact with associated cleaning medium brushes 62, 64. Soiled solution and airflow through elongate apertures 92, 94 is joined at an upper portion of extractor 42 for further removal through hose 44 to recovery tank 14. Elongate apertures 92, 94 are sized in relation to brushes 62, 64 to remove soiled solution across substantially the entire transverse length of the brushes. An alternative vacuum extractor may include two separate vacuum extractor heads each having separate conduits to the recovery tank. As depicted in FIG. 5, extractor 42 defines an interior region 98 in which nozzle 34 is provided. A spray of cleaning solution 13 directed toward cleaning medium 40, namely brushes 62 and 64, from nozzle 34 is intended to be generally contained within interior region 98.

Figure 7:
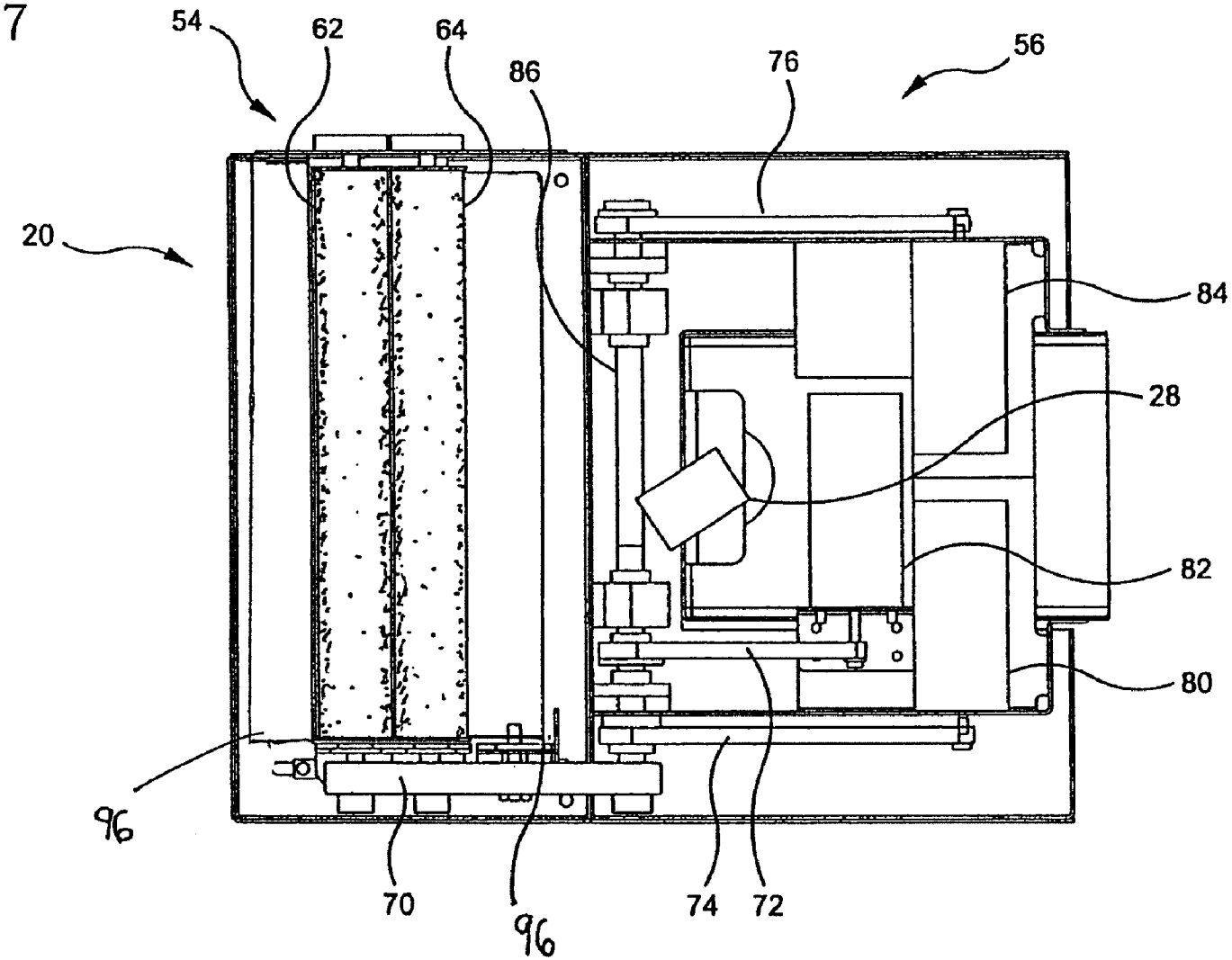
FIG. 7 is bottom plan view of the cleaning head of FIG. 1.

FIGS. 5-7 disclose an additional feature of the invention, that of drip guards 96. In the absence of drip guards 96, large droplets 97 of cleaning solution formed on the walls 98 of the cleaning head 20 will tend to drop onto the carpet surface 25. This may result in a speckled or uneven appearance. Drip guards 96 serve to prevent droplets 97 from reaching carpet surface 25 during the cleaning process. Drip guards 96 extend substantially the entire length of cleaning brushes 64, 66 and are provided in contacting relation with cleaning brushes 64, 66. Drip guards 96 function to redirect cleaning solution thrown from brushes 64, 66 back onto brush 64. As a result, large droplets 97 of cleaning solution are prevented from being dropped onto the carpet surface 25. Drip guards 96 are illustrated as a generally planar form. Alternative embodiments of drip guards 96 may include curved or other complex forms. Drip guards 96 may be formed as an integral portion of cleaning head 20 or may be a separate attachment secured within cleaning head 20. In one embodiment, drip guards 96 are formed from 0.060 inch thick steel. In other embodiments, drip guards 96 may be formed from one or more different materials and may have thicknesses which are different than 0.060 inch think.

In operation, machine 10 is operator-propelled across a surface. In accordance with the present invention, machine 10 may be bi-directionally operated—i.e., machine 10 may be propelled forwardly or rearwardly during operation. To initiate a cleaning operation, appropriate controls, such as switches (not shown), are used to activate vacuum motor 46, cleaning medium drive 60 and cleaning liquid pump 30. Upon activation, brushes 62, 64 of cleaning medium 40 are revolved via drive assembly 60 and cleaning liquid 13 is dispensed through spray nozzle 34 to cleaning medium brushes 62, 64.

Wetted portions of brushes 62, 64 may be defined as those brush portions which receive cleaning liquid from the spray nozzle 34. Regarding brush 62, which rotates in a referenced clockwise manner, the wetted portion is generally that portion of brush 62 between approximately 9 o'clock and 12 o'clock. Regarding brush 64, which rotates in a referenced counter-clockwise manner, the wetted portion is generally that portion of brush 64 between approximately 3 o'clock and 12 o'clock. Referring to FIG. 6, wetted portions of brushes 62, 64 are designated as numerals 100, 102. The relative dampness or wetness of wetted portions 100, 102 is of course dependent upon the quality of the spray exiting nozzle 34 and the rate of rotation of cylindrical brushed 62 and 64. For example, increased wetness of brushes 62 and 64 may be achieved by a slower rate of rotation and/or increased spray through nozzle 34.

Prior to wetted brush portions 100, 102 being rotated into contact with carpet surface 25, the relative dampness is reduced by operation of vacuum extractor 42. Vacuum extractor 42 engages each brush 62, 64 to remove some of the just deposited cleaning liquid 13 and soil previously transferred from the carpet surface. Each brush 62, 64 of the cleaning medium 40 is engaged by respective vacuum apertures 92, 94 of vacuum extractor 42 to reduce the local wetness of brushes 62, 64. As a result, rotating brushes 62, 64 have a wetted portion 100, 102 as defined above, and a reduced wetness portion 104, 106 which engages the carpet surface and transfers soil from the carpet to brushes 62, 64.

As brushes 62, 64 are revolved, reduced wetness brush portions 104, 106 engage the carpet fibers and cause soil to be transferred from the carpet fibers to brushes 62, 64. As brushes 62, 64 are further rotated, the reduced wetness portions 104, 106 (having received soil from the carpet) are sprayed with cleaning liquid through nozzle 34 and subsequently vacuum extracted through extractor 42 to convey soiled cleaning liquid from brushes 62, 64 into soiled solution recovery tank 14.

The cleaning process, in accordance with the present invention, thus includes the steps of wetting a portion of cleaning medium 40 with cleaning liquid 13, reducing the relative wetness of the wetted portion of the cleaning medium by extraction, and then wiping the surface intended to be cleaned with the cleaning medium so as to transfer soil from the surface intended to be cleaned to the cleaning medium 40. Soil upon the cleaning medium 40 is subsequently removed as the revolving cleaning medium is rewetted and extracted. In turn, the aforesaid cleaning process repeats as a cycle with cleaning medium 40 revolving, cleaning liquid 13 being conveyed to cleaning medium 40, extractor 42 reducing the relative wetness of a portion of the cleaning medium 40 (and removing soiled solution therefrom), and cleaning medium 40 wiping the carpet to transfer soil from the carpet to the cleaning medium 40.

Additional aspects of the present invention will be addressed. It is envisioned that the cleaning process according to the present invention may be performed on a variety of different machines, ranging from small manually operated devices, to large self-propelled vehicles. The illustrated device is a self-contained portable cleaning machine, more particularly an operator propelled unit with solution, pump, brush, and vacuum recovery tank. In alternative embodiments, machine 10 may include a vehicle, such as a ride-on or towed-behind vehicle, or be a hand held machine performing a cleaning operation as described herein. Machine 10 may be powered through an on-board power source, such as batteries or an IC engine.

In alternative embodiments, cleaning head 20 may be provided as an accessory or optional item for use with other cleaning machines. In other embodiments, cleaning head 20 may be utilized upon larger, operator driven machines.

Embodiments of the present invention may be utilized for cleaning a variety of floor surfaces, including but not limited to carpets, rugs, tile, vinyl, terrazzo, wood floors, and concrete surfaces. Additional surfaces which may be cleaning through a process as described herein include walls, stairways, upholstered furniture or fabric, such as curtains and the like. In a particularly preferred embodiment and as described herein with reference to machine 10 operation, the present invention is utilized for cleaning floor coverings.

Surface cleaning medium 40 may be one or more elongated cylindrical elements, as depicted in the Figures, wherein each elongated cylindrical element rotates about a generally horizontal axis of rotation generally in parallel with the surface intended to be cleaned. The axis of rotation in a particularly preferred embodiment being aligned generally transverse to the direction of intended machine 10 operation. Alternatively, cleaning medium 40 may be one or more disk-shaped elements which rotate about one or more generally vertical axes of rotation generally transverse to the surface intended to be cleaned.

Yet another embodiment of cleaning medium 40 may include a belt, with an outward belt surface being a cleaning medium, trained between two or more rollers, the belt moving as the rollers rotate. With this belt-type cleaning medium, it should be appreciated that the belt is intended to revolve so that the outward belt surface having the cleaning medium thereon sequentially passes a wetting operation, followed by an extraction process, followed by a soil transfer process—i.e., wiping the intended surface to be cleaned with cleaning medium surface of the belt. Additional embodiments of cleaning mediums are of course possible as may be appreciated by those skilled in the relevant arts.

In another embodiment cleaning medium 40 may be a cylindrical shaped element having a combination of foam and bristle surfaces. (not shown) In alternative embodiments, cleaning medium 40 may comprise a revolving belt as aforesaid. Cleaning medium 40 may include a variety of different materials including fabrics, synthetic scouring pads and foam elements and the like which serve the intended function of transferring soil from a surface being wiped onto the cleaning medium.

Extractor 42 may be provided by a wide array of structures and techniques as may be appreciated by those skilled in the relevant arts including, including but not limited to non-vacuum techniques such as pressing or squeezing, all of which are intended to be within the true spirit and scope of the present invention.

Further, although cleaning solution dispenser 22 is illustrated as being operated by a pump on the main assembly of machine 10, other arrangements are of course possible so as to achieve the intended function. As used herein, and the appended claims, the cleaning liquid may comprise any cleaning solution which assists the transfer of the soil on the surface intended to be cleaned unto the cleaning medium. For example, cleaning liquid 13 could also be in the form of a foam, vapor, liquid with suspended solids, a granular cleaning material, plain water, and the like. Of course, liquid dispenser 22 would be of different form than that as illustrated in order to accommodate the selected cleaning liquid or material. Therefore, as used herein and the appended claims, wetting of the cleaning medium encompasses, but not limited to, depositing, applying, or conveying such material onto the cleaning medium 40.

In alternative embodiments of the present invention, cleaning head 20 may be coupled to machine 10 via a plurality of pivot points, a four bar linkage, or alternative structures which facilitate head movement and cleaning medium engagement across both even and uneven floor surfaces.

Other modifications to the described embodiment may also be practicable. One or more cleaning liquid dispensing devices may be utilized in alternative embodiments of the invention. Additionally, the vacuum extractor may be alternatively configured and include a different extractor structure. For example, a plurality of vacuum extracting locations may be practicable, i.e., a first vacuum extraction location for reducing the relative dampness of the rotating cleaning medium prior to contact with the floor surface, and a second vacuum extraction location for removing soiled solution from the cleaning medium. In yet another example, a rotating belt machine may include a first cleaning liquid dispensing device, a first extraction device for reducing the dampness of the belt prior to contact with carpet, a second cleaning liquid dispensing device, and a second extraction device for removing soiled solution from the belt. As various changes could be made in the above methods and devices without departing from the scope of the invention, it is intended that all matter contained in the above description or shown in the accompanying drawings shall be interpreted as illustrative and not in a limiting sense.

We claim:

1. A method of removing soil from a surface intended to be cleaned using a movable machine, said method comprising:

moving the movable machine across the surface while repeatedly:

spraying a wetted portion of a revolving cylindrical cleaning medium with a cleaning liquid, said cleaning liquid carried in cleaning solution tank on said movable machine;

after said spraying, rotating said wetted portion of the cleaning medium into contact with a vacuum extractor, said vacuum extractor defining an elongated slot opening which extends from one end of the cleaning medium to an opposite end, with said vacuum extractor being coupled to a vacuum conduit, and said slot opening having a substantially narrower diameter than said cleaning medium and said vacuum conduit, with ends of said vacuum extractor engaging fibers of said wetted portion of said cylindrical cleaning medium during said contact;

with said vacuum extractor, extracting soil and cleaning liquid from said wetted portion of the revolving cleaning medium through said slot opening prior to said wetted portion revolving into contact with the surface to be cleaned;

after said extracting, rotating said wetted portion of the cleaning medium out of contact with said vacuum extractor and toward contact with said surface to be cleaned, with said rotating causing the wetted portion of the cylindrical cleaning medium to rotate away from contact with said ends of said vacuum extractor;

during said rotating, wiping the surface with said wetted portion of the revolving cleaning medium so as to transfer soil from the surface to the cleaning medium; and after said wiping, sequentially repeating said steps of spraying, rotating, extracting, rotating, and wiping as said movable machine is moved across the surface.

2. The method of claim 1 further comprising:

contacting said previously wetted portion of the cleaning medium with a drip guard, said drip guard extending substantially across a length of said cleaning medium, and said drip guard redirecting cleaning solution thrown from the revolving cleaning medium back onto the cleaning medium, thereby preventing droplets of cleaning solution from falling onto the surface intended to be cleaned.

3. The method of claim 1 wherein said spraying the portion of the revolving cleaning medium includes spraying cleaning liquid onto the cleaning medium from a nozzle.

4. The method of claim 3 wherein substantially all spray output from said nozzle is directed onto the cleaning medium.

5. The method of claim 1 wherein said vacuum extractor includes a pair of vertical walls and portions of the slot openings are defined at ends of the pair of walls, and with an airflow through said slot openings being combined into a single vacuum conduit.

6. A method of removing soil from a surface intended to be cleaned using a movable machine, said method comprising:

moving the movable machine across the surface while repeatedly:

spraying a portion of a revolving cylindrical cleaning medium with a cleaning liquid;

after said spraying, revolving said wetted portion of the cleaning medium into contact with a vacuum extractor, said vacuum extractor having an elongated slot opening having a slot width which is substantially narrower than a diameter of said cleaning medium and a diameter of a vacuum conduit connected to an end of said vacuum extractor, with ends of said vacuum extractor engaging fibers of said wetted portion of said cylindrical cleaning medium;

with said vacuum extractor, extracting via vacuum-action soil and cleaning liquid from said wetted portion of the revolving cleaning medium through said elongated slot opening prior to said wetted portion revolving into contact with the surface to be cleaned;

after said extracting, revolving said wetted portion of the cleaning medium out of contact with said vacuum extractor and toward contact with said surface to be cleaned, said revolving moving the engaged fibers of the wetted portion of the cylindrical cleaning medium away from contact with the vacuum extractor;

wiping the surface with said wetted portion of the revolving cleaning medium so as to transfer soil from the surface intended to be cleaned to the cleaning medium, wherein the cleaning medium includes a pair of elongated cylindrical shaped elements which are counter-rotated relative to each other and wherein portions of said pair of elements contact each other as the cleaning medium revolves; and sequentially repeating said steps of spraying, rotating, extracting, rotating and wiping as said movable machine is moved across the surface.

7. The method of claim 6 wherein said extracting is achieved through a pair of vacuum apertures, each of said pair of vacuum apertures being associated with a different one of a pair of counter-rotated elongated cylindrical shaped elements.

8. The method of claim 7 wherein said spraying includes spraying cleaning solution with a spray nozzle located above said pair of elongated cylindrical shaped elements, and with said pair of elongated generally cylindrical shaped elements being in contact with each other so as to prevent sprayed cleaning solution from being directly sprayed onto the surface intended to be cleaned.

9. The method of claim 6 wherein the surface is a carpet surface, and wherein wiping the surface transfers soil from fibers of the carpet surface to the cleaning medium.

10. The method of claim 6 wherein the surface is a fabric surface, and wherein wiping the surface transfers soil from fibers of the fabric surface to the cleaning medium.

11. The method of claim 6 wherein said vacuum extractor includes a pair of vertical walls and said slot opening is defined at ends of said walls.

12. The method of claim 6 further comprising:

contacting said previously wetted portion of the cleaning medium with a drip guard, said drip guard extending substantially across a length of said cleaning medium, and said drip guard redirecting cleaning solution thrown from the revolving cleaning medium back onto the cleaning medium, thereby preventing droplets of cleaning solution from falling onto the surface intended to be cleaned.

13. A method of cleaning a carpeted surface, said method being performed by a surface maintenance machine and comprising:

spraying a portion of a revolving cleaning medium with a cleaning liquid;

after said spraying, with a vacuum extractor, removing some soil and some of the cleaning liquid from the previously wetted portion of the cleaning medium, with fibers of said previously wetted portion of the cleaning medium being rotated into contact with a perimeter of an elongated slot opening of said vacuum extractor, with said slot opening being narrower than a diameter of said revolving cleaning medium and a diameter of a vacuum conduit connected to said vacuum extractor, said removing drawing soil and cleaning liquid on said fibers through said elongated slot opening of said vacuum extractor;

after said removing, revolving said fibers away from contact with the vacuum extractor and into contact with the carpeted surface;

wiping the carpeted surface with the fibers of said portion of the revolving cleaning medium so as to transfer soil from the carpeted surface to the cleaning medium; and sequentially repeating said spraying, removing, contacting and wiping the carpeted surface during a carpet cleaning procedure.

14. The method of claim 13 wherein said spraying involves pumping a cleaning liquid from a reservoir carried by the surface maintenance machine through a nozzle, said nozzle spraying substantially all of its spray output directly onto the cleaning medium, with said cleaning medium being positioned between the nozzle and the surface intended to be cleaned.

15. The method of claim 13 wherein said wiping involves rotating the cleaning medium into contact with the carpeted surface, and said vacuum extractor includes a vacuum extractor slot extending substantially along across the cleaning medium, with said vacuum extractor slot being positioned between said nozzle and said carpeted surface.

16. The method of claim 13 wherein the cleaning medium is cylindrical and is rotated about an axis which is perpendicular to a direction of machine use, and said vacuum extractor slot includes a pair of generally parallel walls, with ends of said pair of walls being in contact with the cylindrical cleaning medium.

17. A method of claim 13 further comprising:

contacting said previously wetted portion of the cleaning medium with a drip guard, said drip guard extending substantially across a length of said cleaning medium, and said drip guard redirecting cleaning solution thrown from the revolving cleaning medium back onto the cleaning medium, thereby preventing droplets of cleaning solution from falling onto the surface intended to be cleaned.

18. The method of claim 13 wherein said vacuum extractor includes a pair of vertical walls and said slot opening is defined at ends of said walls.

* * * * *